United States Patent [19]

Braxmeier

[11] Patent Number: 4,961,308

[45] Date of Patent: Oct. 9, 1990

[54] MACHINE FOR PNEUMATIC FALSE-TWIST SPINNING

[75] Inventor: Hans Braxmeier, Süssen, Fed. Rep. of Germany

[73] Assignees: Hans Stahlecker; Fritz Stahlecker, both of Fed. Rep. of Germany

[21] Appl. No.: 237,331

[22] Filed: Aug. 29, 1988

[30] Foreign Application Priority Data

Sep. 3, 1987 [DE] Fed. Rep. of Germany ..... 3729426

[51] Int. Cl.[5] ..... D01H 5/28; D01H 1/24; D01H 1/28; D01H 15/02

[52] U.S. Cl. ..... 57/328; 57/78; 57/261

[58] Field of Search ..... 57/261–263, 57/328, 78, 80, 81, 333

[56] References Cited

U.S. PATENT DOCUMENTS

| | | | |
|---|---|---|---|
| 3,992,865 | 11/1976 | Tuchida et al. | 57/328 |
| 4,121,409 | 10/1978 | Uchida et al. | 57/261 X |
| 4,545,193 | 10/1985 | Tanaka et al. | 57/261 |
| 4,569,192 | 2/1986 | Yamada et al. | 57/328 X |

*Primary Examiner*—John Petrakes

*Attorney, Agent, or Firm*—Barnes & Thornburg

[57] ABSTRACT

In the case of a process for stopping and restarting a machine for pneumatic false-twist spinning, it is provided that the start-up time and the slow-down time of the main motor are controlled to preselected values, so that the switching-on and switching-off operations for air nozzles may take place as a corresponding function.

17 Claims, 2 Drawing Sheets

MACHINE FOR PNEUMATIC FALSE-TWIST SPINNING

BACKGROUND AND SUMMARY OF THE INVENTION

The invention relates to a process and apparatus for stopping and restarting a machine for pneumatic false-twist spinning of the type having a plurality of spinning units which each have at least one drafting frame, one pneumatic false-twisting nozzle, one withdrawal device and one wind-up device. A main motor is provided for driving the drafting frames, the withdrawal devices and the wind-up devices. A blower motor for a blower is connected with the false-twist nozzles via at least one solenoid valve. The main motor is switched off and on for the stopping and restarting, and the blower motor and the solenoid valves are switched as a function of the main motor.

In pneumatic false-twist spinning, the strength of the spun yarn is caused exclusively via the air nozzles (the pneumatic false-twisting nozzles). This means that, when a false-twist spinning machine is stopped and restarted, yarn breakages will occur immediately if the air nozzles are no longer acted upon by compressed air and the drafting frames and the withdrawal devices are still running. For stopping a machine for pneumatic false-twist spinning without any yarn breakages, it is known (DE-25 33 655 C2) corresponding to U.S. Pat. No. 3,992,865 to Tuchida et al., to switch time function elements together with the switching of the main motor. Via these time function elements, the blower motor and the solenoid valves are switched off such that the main motor is stopped before the compressed-air supply to the air nozzles is switched off. During the restarting, the sequence is reversed; i.e., first the blower motor and the solenoid valves are switched on, after which, after a given time delay, the main motor is restarted. In this case, the time function elements are set to a time that, on the basis of experiments, is required until the main motor is stopped completely or, vice versa, has regained its normal speed. These types of experimental values must be determined and set at each machine because, on the one hand, the slow-down behavior and the starting behavior depend on the machine, i.e., the number of spinning points or units and the respectively set operating speed. On the other hand, deviating requirements with respect to strength and also with respect to the danger of yarn breakage exist for every yarn size, so that readjustments are required in each case. In this case, it must be taken into account that the compressed-air supply must also not remain switched on for a considerable period of time after the stoppage of the main motor because otherwise there is the danger that the yarns are torn as a result of overtwisting.

An object of the invention is to provide a process and apparatus of the initially mentioned type by means of which the stopping and the restarting may be carried out with values that were set once, irrespective of the operating conditions of the machine and of the spun yarn type.

This object is achieved in that the start-up time and the slow-down time of the main motor are controlled to preselected values.

In a further development of preferred embodiments of the invention, it is provided that the rotational speed of the main motor is measured during the stopping and during the restarting, and in that the solenoid valve and the blower motor, during the stopping, are not switched off before the rotational speed of the main motor has fallen to a preselected value, and in that the solenoid valve and the blower motor, during the restarting, are not switched on before the rotational speed of the main motor has reached a preselected rotational speed. Thus, a process for the stopping and restarting is provided that is largely independent of the design or the method of operation of the respective false-twist spinning machine because the switching always takes place at given rotational speeds.

In a further development of preferred embodiments of the invention, it is provided that, for triggering the switching of the solenoid valve and of the blower motor, during the stopping and/or during the restarting, the reaching and/or the leaving of the zero rotational speed is preselected. As a result, the slow-down behavior and also the start-up behavior of the main motor is automatically also taken into account, while, nevertheless, the switching-on and/or the switching-off of the compressed-air supply always takes place at an appropriate point in time. The compressed-air supply remains fully switched on until the main motor has come to a stop. As a result, the yarn is twisted a little too much during the stopping phase. However, during the switching-on of the main motor, the air supply is switched on again as soon as the main motor is set in motion. Since a certain time span is required until the complete air pressure is available again at all air nozzles or pneumatic false-twisting nozzles, the yarns, during the start-up, receive slightly too little twist. The overtwisting during the stopping is therefore compensated by the slightly reduced twisting during the restarting.

In a further development of preferred embodiments of the invention, it is provided that the solenoid valve, during the stopping, connects the air nozzles with the atmosphere. As a result, it is ensured that, immediately with the actuating of the solenoid valve, the compressed-air supply is interrupted, without the switch-off time or the slow-down time of the blower and of the blower motor having any influence on this interruption.

In a further development of preferred embodiments of the invention, it is provided that the solenoid valve, during the stopping, connects the air nozzles, via a preferably adjustable throttling device, with the atmosphere. By means of the preferably adjustable throttling device, the switching-off of the compressed-air supply can be influenced further.

Other objects, advantages and novel features of the present invention will become apparent from the following detailed description of the invention when considered in conjunction with the accompanying drawings.

DETAILED DESCRIPTION OF THE DRAWINGS

Figure 1:
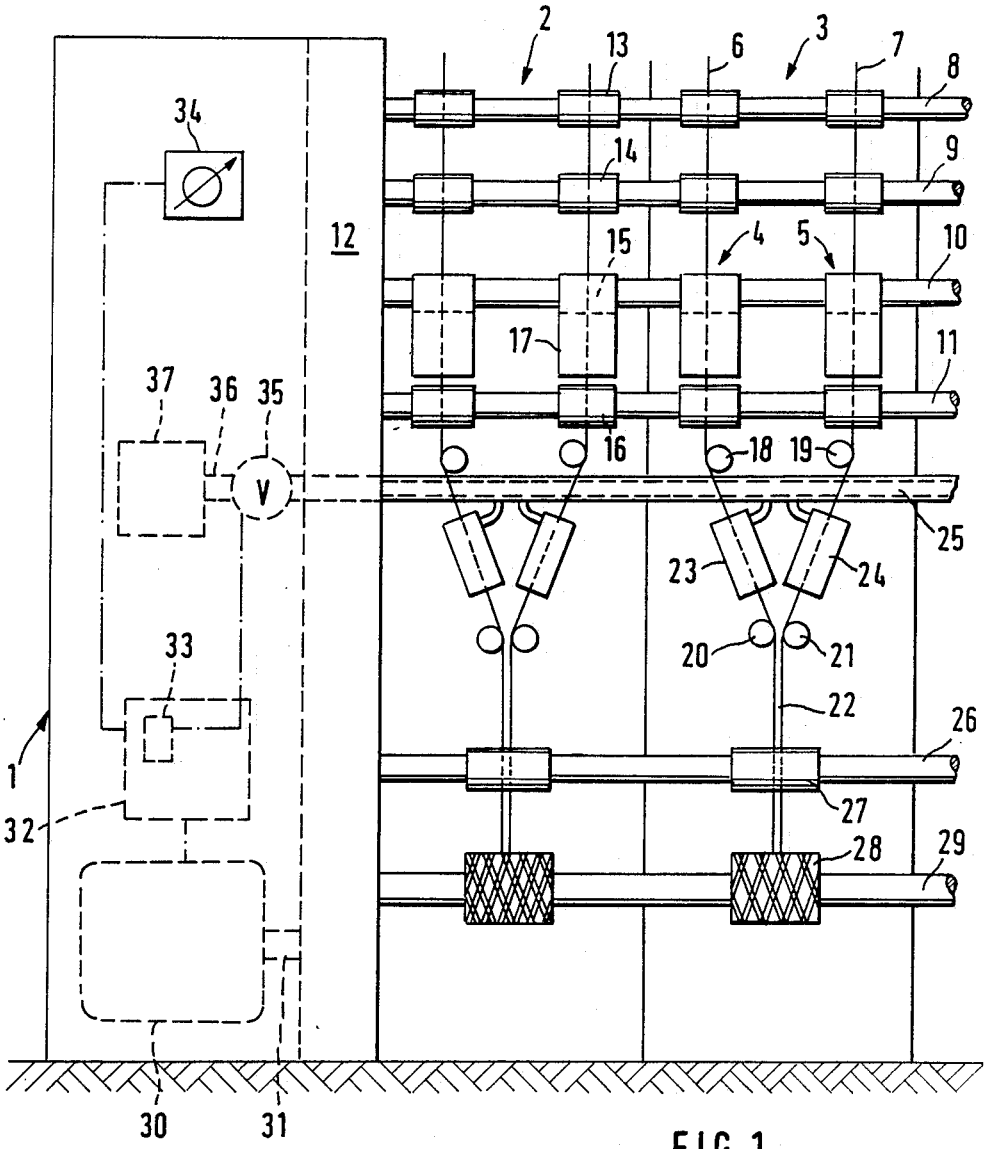
FIG. 1 is a schematic partial view of a machine for pneumatic false-twist spinning, taken from the direction of the operating side, constructed in accordance with a preferred embodiment of the invention.

The machine for pneumatic false-twist spinning shown in FIG. 1 contains a plurality of spinning points or units 2, 3, of which only those two are shown which are located in the area of one machine end and are adjacent to one another. The false-twist spinning machine is also equipped with a driving head 1 which is arranged as an extension of the individual spinning units 2, 3.

Each of the spinning units 2, 3 contains two drafting frames 4, 5 which are aligned in parallel to one another and which each draw a sliver 6, 7 to the desired yarn size. All drafting frames 4, 5 of all spinning units 2, 3 are equipped with driven bottom cylinders 8, 9, 10, 11 extending in the longitudinal direction of the machine, to which top rollers 13, 14, 15, 16 are assigned at the individual drafting frames 4, 5. The top rollers 13 to 16 of, in each case, one spinning unit 2, 3 are combined to pairs of pressure rollers. In addition, the drafting frames 4, 5 contain belt or tape guides, of which, in the view according to FIG. 1, the upper belt guides 17 are visible.

The drafting frames 4, 5 of the spinning units 2, 3, in the travelling direction of the slivers 6, 7, are followed by air nozzles or pneumatic false-twisting nozzles 23, 24 which are arranged in such a manner that the slivers 6, 7 converge in a V-shape. Yarn guides 18, 19 are arranged between the drafting frames 4, 5 and the air nozzles 23, 24. Connected behind the air nozzles 23, 24 are additional yarn guides 20, 21, which guide the two slivers 6, 7 closer to one another, but not so close that they touch one another completely. Subsequently, the two slivers 6, 7 are guided further along as a double yarn 22 which is withdrawn by means of a withdrawal device 26, 27 and by means of a wind-up device 29, which is shown only schematically, is wound up to a side-by-side cross-wound package 28.

The air nozzles 23, 24 are supplied with compressed air via a compressed-air pipe 25 extending through in the longitudinal direction of the machine. The air nozzles 23, 24, in a known manner, are developed such that they provide the drawn slivers 6, 7 with a false-twist which opens up again behind the air nozzles 23, 24. In this case, however, spread-away fiber ends remain wound around the slivers 6, 7 consisting essentially of parallel fibers, these spread-away fiber ends providing the strength. In the case of the shown false-twist spinning machine, the air spinning is only carried out to such an extent that, by means of the winding-around of the fiber ends, a certain prestrengthening is obtained which is sufficient for being able to withdraw the double yarn 22 and wind it up without the individual yarn components receiving such a strength that they themselves could be further processed as a yarn. The final strength for the further processing is provided to the double yarn 22 by means of a subsequent twisting process on a separate machine to which the packages 28 are fed.

The withdrawal device contains a driven cylinder 26 extending through in the longitudinal direction of the machine and in each case one pressure roller 27 for each spinning unit. The wind-up devices have a joint driven shaft 29 extending through in the longitudinal direction of the machine. In addition, elements are provided that are not shown, such as a traverse-motion device, a spool frame or the like.

The bottom cylinders 8, 9, 10, 11 of the drafting frames 4, 5, the cylinder 26, and the joint shaft 29 are driven by a joint main motor 30, the shaft 31 of which, via a gearing 12 that is shown only schematically, is connected with the mentioned driven elements. The compressed-air supply of the air nozzles 23, 24 via the compressed-air pipe 25 takes place via a blower 37 that is shown only schematically and that contains its own blower motor. The blow-out pipe 36 of the blower 37 is connected with the compressed-air supply pipe 25 via a solenoid valve 35.

The rotational speed of the main motor 30 can be adjusted via a frequency regulating device 32. The adjustment of the frequency regulating device 32 takes place from a control field 34 which contains an indicating device concerning the respective selected adjustment. The frequency regulating device 32 contains a generator 33 which detects the frequency of the main motor 30 and emits a signal in the case of a given rotational speed.

The control field 34 contains circuit closer and circuit breakers for the main motor 30. These are applied to the frequency regulating device 32 which, in the case of a corresponding signal, decelerates the main motor 30 according to a given program in a given time, from the rotational operating speed to zero rotational speed, or accelerates it from zero rotational speed to the rotational operating speed. The start-up time and the slow-down time may therefore be regulated to a constant value which is between 10 and 30 seconds and which will then be maintained irrespective of how the pneumatic spinning machine is constructed otherwise, i.e., for example, irrespective of the adjusted operating speed and also of the number of spinning units.

As shown schematically in FIG. 1, the generator 33 is connected with the solenoid valve 35 via a switching device that is not shown and that provides that the solenoid valve 35 is switched such that the air supply to the air nozzles 23 and 24 is interrupted when zero rotational speed of the main motor 30 or the correspondent frequency is detected. As a result, it is achieved that, when the machine for pneumatic false-twist spinning is stopped, the air supply definitely remains switched on as long as the drafting frames 4, 5, the withdrawal device 26, 27 and the wind-up device 29 are still running. When the machine is restarted, the magnetic valve 35 is immediately switched into the position in which compressed air is supplied to the air nozzles 23, 24 as soon as the main motor 30 leaves zero rotational speed, i.e., it moves. In a manner that is not shown, the blower motor of the blower 37 is switched on and off simultaneously with the electromagnet 35.

In the embodiment according to FIG. 1, it is not necessary to stop and restart the main motor 30 via the frequency control device 32 always according to a given program and with a given slow-down time or start-up time, because a suitable balancing takes place automatically as a result of the provided control of the solenoid valve 35 and of the blower motor via the generator 33.

Figure 2:
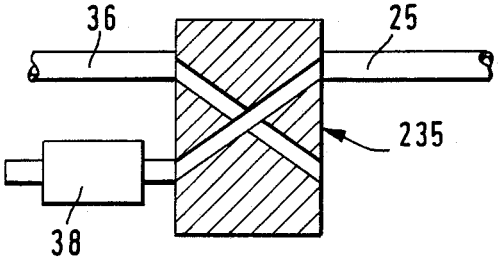
FIG. 2 is a schematic view of a solenoid valve connecting the air nozzles of the spinning unit with a blower of the embodiment of FIG. 1, depicting the same in its switch-off position.
Figure 3:
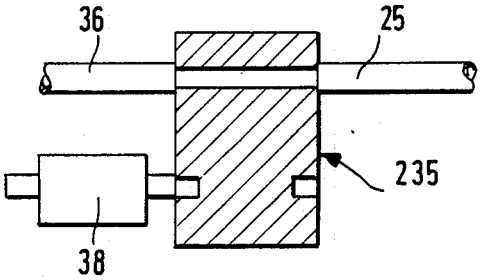
FIG. 3 is a schematic view of the solenoid valve of FIG. 2 depicted in the operating position.

As shown in FIGS. 2 and 3, it is provided in a modified embodiment that the solenoid valve 235 which connects the blow-out pipe 36 with the compressed-air supply pipe 25 is also connected to a throttling device 38. In the operating position (FIG. 3), the solenoid valve 235 connects the blow-out pipe 36 with the compressed-air supply pipe 25. In the switched-off position (FIG. 2), the solenoid valve 235 connects the compressed-air supply pipe 25 with the throttling device 38 which preferably is adjustable. As a result, it becomes possible to vent the compressed-air supply pipe 25 very rapidly and particularly without the influence of the blower 37 and of the blower motor, i.e., to interrupt the compressed-air supply.

Figure 4:
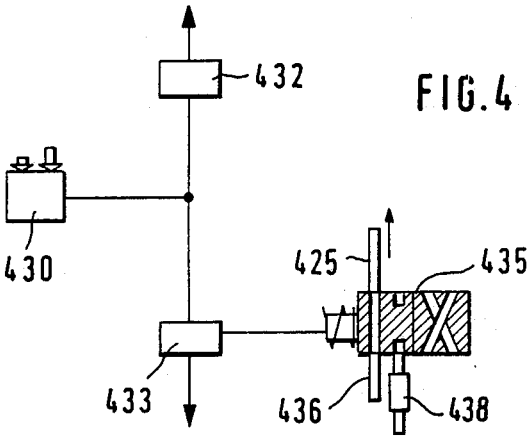
FIG. 4 is a schematic representation of a block diagram for a circuit for the stopping and restarting of a false-twist spinning machine according to preferred embodiments of the present invention.

FIG. 4 shows a slightly modified circuit by means of which the main motor 30 and a solenoid valve 435 are switched and which is arranged between the blow-out pipe 436 of a blower and a compressed-air supply pipe 425 and which is also equipped with a throttling device 438. In the case of this circuit, it is provided that a circuit closer and breaker 430 acts upon the frequency regulating device 432 and simultaneously starts up time function elements 433. The frequency regulating device 432 switches off the main motor which is not shown. The time function elements 433, corresponding to set values, switch the solenoid valve 435 and the blower motor which is not shown. Since the switching-off of the main motor 30 takes place according to a given program, i.e., with a given slow-down time, and the switching-on also takes place according to a given program with a given start-up time, a fixed setting may be provided for the time function elements 433 which does not have to be changed in the case of change-overs to other yarn sizes or other fiber materials.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A process for stopping and restarting a machine for pneumatic flase-twist spinning having a plurality of spinning units which each have at least one drafting frame, one pneumatic flase-twisting nozzle, one withdrawal device, and one wind-up device, wherein a main motor is provided for driving the drafting frames, the withdrawal devices and the wind-up devices, wherein a blower motor is provided for a blower which is connected with the air nozzle via at least one solenoid valve, said process comprising:

switching the main motor off and on for the stopping and restarting;

controlling the start-up time and the slow-down time of the main motor to preselected values, and controlling the operation of the blower motor and the at least one solenoid valve as a function of the main motor rotational speed.

2. A process of according to claim 1, wherein the controlling of the operation of the blower motor and the at least one solenoid valve includes detecting the rotational speed of the main motor during the stopping and the restarting, wherein the solenoid valve, during the stopping, is not switched off b before the rotational speed of the main motor has fallen to a preselected value, and wherein the solenoid valve, during the restarting, is not switched on before the rotational speed of the main motor has reached a preselected rotational speed.

3. A process according to claim 2, wherein the controlling of the operation of the blower motor and the at least one solenoid valve includes preselecting the same rotational speed value of the main motor for the triggering of the switching process of the solenoid valve during both the stopping and the restarting.

4. A process according to claim 2, wherein for the triggering of the switching of the solenoid valve during the stopping, the reaching of zero rotational speed is preselected.

5. A process according to claim 2, wherein for the triggering of the switching of the solenoid valve during the restarting, the leaving of zero rotational speed is preselected.

6. A process according to claim 2, wherein the controlling of the operation of the blower motor and the at least one solenoid valve includes switching the solenoid valve via time switches and simultaneously restarting the main motor.

7. A process according to claim 2, comprising connecting the air nozzles with the atmosphere via the at least one solenoid valve during the stopping.

8. A processing according to claim 7, comprising connecting the at least one air nozzle via a preferably adjustable throttling device with the atmosphere using the at least one solenoid valve.

9. A process according to claim 1, wherein the controlling of the operation the blower motor and the at least one solenoid valve includes preselecting the same rotational speed value of the main motor for the triggering of the switching process of the solenoid valve during both the stopping and the restarting.

10. A process according to claim 1, wherein for the triggering of the switching of the solenoid valve during the stopping, the reaching of zero rotational speed is preselected.

11. A process according to claim 1, wherein for the triggering of the switching of the solenoid valve during the restarting, the leaving of zero rotational speed is preselected.

12. A process according to claim 1, wherein the controlling of the operation of the blower motor and the at least on solenoid valve includes switching the solenoid valve via time switches and simultaneously restarting the main motor.

13. A process according to claim 1, comprising connecting the air nozzles with the atmosphere iva the at least one solenoid valve during the stopping.

14. A process according to claim 13, comprising connecting the at least one air nozzle via a preferably adjustable throttling device with the atmosphere using the at least one solenoid valve.

15. Apparatus for stopping and restarting a machine for pneumatic flase-twist spinning having a plurality of spinning units which each have at least one drafting frame, one pneumatic flase-twisting nozzle, one withdrawal device, and one wind-up device, wherein a main motor is provided for driving the drafting frames, the withdrawal devices and the wind-up devices, wherein a blower motor is provided for a blower which is connected with the air nozzles with at least one solenoid valve, said apparatus comprising:

main motor switch means for switching the main motor off and on for the stopping and restarting;

main motor control means for controlling the start-up time and slow-down time of the main motor to preselected values, and blower motor and solenoid control means for controlling the operation of the blower motor and the at least one solenoid valve as a function of the main motor rotational speed.

16. Apparatus according to claim 15, comprising detecting means for detecting the rotational speed of the main motor during the stopping and the restarting, wherein the blower motor and solenoid control means includes means for switching off the blower motor and solenoid valve during stopping only after the rotational speed of the main motor has fallen to a preselected value, and wherein the solenoid valve, during the restarting, is not switched on before the rotational speed of the main motor has reached a preselected rotational speed.

17. An apparatus according to claim 16, wherein said preselected rotational speed is zero.

* * * * *